United States Patent [19]

Jackson et al.

[11] 4,452,680

[45] Jun. 5, 1984

[54] ELECTROCOATING APPARATUS AND METHOD OF USE THEREOF

[76] Inventors: Douglas H. Jackson, 24 Adkin Way, Wantage, Oxon; Jack R. Madley, 11 Pettiwell, Garsington, Oxon; Dennis C. Lathwell, 33 Nobles Close, Grove, Wantage, Oxon, all of England

[21] Appl. No.: 309,349

[22] Filed: Oct. 7, 1981

[30] Foreign Application Priority Data

Oct. 15, 1980 [GB] United Kingdom ..... 8033283

[51] Int. Cl.[3] ..... C25D 13/18

[52] U.S. Cl. ..... 204/181 R; 204/181 C; 204/300 EC

[58] Field of Search ..... 204/181 C, 300 EC, 181 R, 204/1 T, 195 R, 228

[56] References Cited

U.S. PATENT DOCUMENTS 3,305,467 2/1967 Igras et al. ..... 204/300 EC
3,476,666 11/1969 Bell et al. ..... 204/181 C
4,082,642 4/1978 Hönig ..... 204/300 EC

FOREIGN PATENT DOCUMENTS 696067 11/1979 U.S.S.R. ..... 204/228
703284 12/1979 U.S.S.R. ..... 204/228

*Primary Examiner*—Howard S. Williams

[57] ABSTRACT

An electrocoating apparatus has a plurality of cells movable successively to each of a plurality of operating stations. An electrical circuit is provided to monitor the cells and initiate the application of electrical pulses to each cell if the cell has not exhibited any faults. Each cell is subjected to a test at two selected operating stations and the result of each test is entered as a binary digit in a respective shift register. As the cell is advanced each binary digit is similarly advanced in its shift register by clock pulses. Unidirectional electrical pulses are applied as electrocoating pulses at electrocoating stations such that each cell is normally subjected to three successive discrete pulses. However, if a cell which has failed either of the test arrives at the electrocoating stations, the presence of its binary digit in the appropriate stage of the shift register inhibits the application of electrocoating pulses thereto. Furthermore, application of the electrocoating pulses to a cell is immediately interrupted if the cell goes short circuit.

24 Claims, 3 Drawing Figures

ELECTROCOATING APPARATUS AND METHOD OF USE THEREOF

BACKGROUND OF THE INVENTION

The present invention relates to electrocoating apparatus, and to circuits and methods for supplying such apparatus and for monitoring their operation.

SUMMARY OF THE INVENTION

According to a first aspect of the present invention there is provided an electrocoating apparatus comprising a plurality of electrocoating cells movable successively to each of a plurality of electrocoating stations at which they are electrically energisable, and means for periodically supplying a unidirectional electrical pulse as an electrocoating pulse to each of said electrocoating stations at a time when electrocoating fluid is present in a cell which is located at the electrocoating station, a plurality of discrete electrocoating pulses being thereby applied to each cell as it is moved to each of said electrocoating stations in succession.

The use of a plurality of electrocoating pulses enables each cell to receive an electrocoating current of sufficient duration to achieve a satisfactory coating thickness without any requirement to limit the design speed of the electrocoating apparatus. It therefore enables the apparatus to be designed for high speed operation and yet be compact and inexpensive to build and to operate.

According to a further aspect of the invention there is provided an electrocoating apparatus comprising at least one electrocoating cell, means for applying one or more unidirectional electrical pulses as electrocoating pulses to said cell at a time when electrocoating fluid is present in said cell, and means for determining the time integral of the current fed to the cell, said time integral being representative of the coulomb quantity fed to said cell.

The coulomb quantity is a measure of the quantity of the coating laid down, and this determination can be used for quality control and/or indication.

The invention also extends to an electrocoating apparatus comprising a plurality of electrocoating cells movable successively to each of a plurality of operating stations, means for supplying unidirectional electrical pulses as electrocoating pulses to a selected one or ones of said operating stations at a time when electrocoating fluid is present in a said cell which is located at the or each of said selected operating station, means for testing at least one parameter of each cell, and means for inhibiting the supply of said electrocoating pulses to any selected operating station at which a cell which fails said test is located.

Some faults to which a cell may be subject can result in damage to the cell if an electrocoating pulse is applied thereto. Thus, the provision of means to inhibit the supply of electrocoating pulses to any cell which has a fault can prevent damage to the apparatus. Generally, the cells will be tested to ensure that there is an article to be electrocoated correctly positioned in the cell, and to ensure that there is not a short circuit in the cell. Furthermore, the supply of electrocoating pulses can also be interrupted if the cell suddenly goes short circuit during electrocoating.

According to another aspect of the invention there is provided an electrocoating apparatus comprising a plurality of electrocoating cells movable successively to each of a plurality of operating stations, means for supplying unidirectional electrical pulses as electrocoating pulses to a selected one or ones of said operating stations at a time when electrocoating fluid is present in a said cell which is located at the or each of said selected operating station, and means representing the movement of each cell to the operating stations in succession.

The provision of means representing the movement of each cell enables the position of each cell to be determined at any time. Preferably, this location information also indicates the condition of the cell. In an embodiment, information relating to the condition of each cell is advanced through one or more shift registers. Each shift register has a plurality of stages, each representing an operating station of the apparatus. Thus, the condition of the cell at any operating station can be determined from the shift registers. Preferably, these shift registers are used to inhibit the application of electrocoating pulses when a faulty cell arrives at an electrocoating station.

The present invention also extends to an electrical supply and monitoring circuit for an electrocoating apparatus, said circuit comprising means for generating a succession of unidirectional voltage pulses and delivering them to one or more output lines as electrocoating pulses for said electrocoating apparatus, and means for inhibiting the generation of said pulses if the current flowing in one or more of said output lines exceeds a predetermined value.

In addition, the present invention extends to an electrical supply and monitoring circuit for an electrocoating apparatus, said circuit comprising means for generating a succession of unidirectional voltage pulses, switching means for connecting said pulses to one or more output lines as electrocoating pulses for said electrocoating apparatus, and information storage means for operating said switching means in accordance with the information in said storage means.

According to a further aspect of the present invention there is provided a method of monitoring and controlling the operation of an electrocoating apparatus in which a plurality of electrocoating cells are moved successively to each of a plurality of operating stations, the method comprising the steps of testing one or more parameters of each cell against a predetermined standard, and only if the cell meets the standard, subsequently applying one or more unidirectional electrical pulses to that cell as electrocoating pulses therefor.

BRIEF DESCRIPTION OF THE DRAWINGS

An embodiment of the present invention will hereinafter be described, by way of example, with reference to the accompanying drawings, in which.

DESCRIPTION OF A PREFERRED EMBODIMENT

Figure 1:
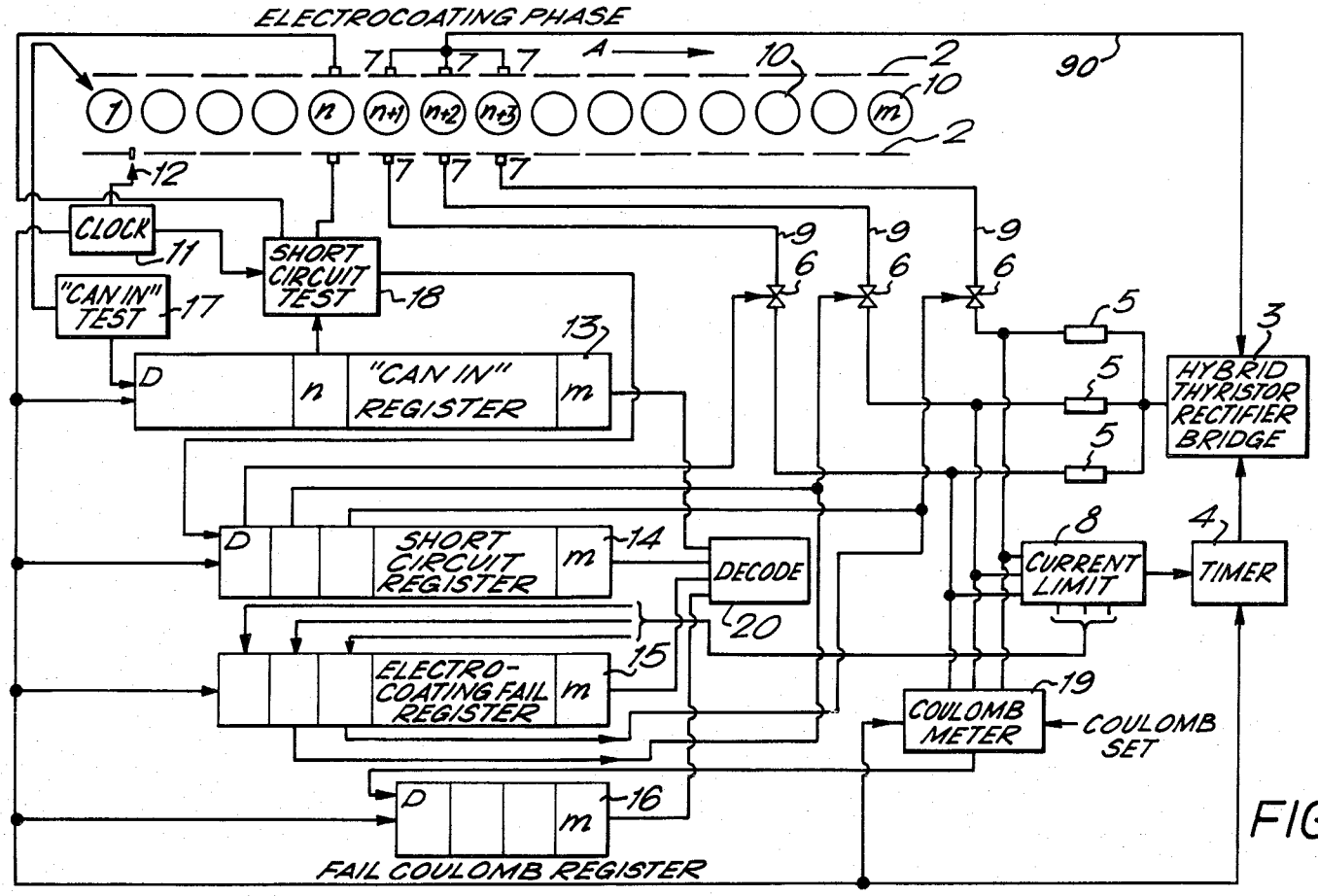
FIG. 1 shows a circuit diagram of an electrical supply and monitoring circuit for an electrocoating apparatus.

It is known to coat electrically conducting surface areas of articles by electrodeposition using a cell in which the article is positioned such that the surface thereof to be coated is spaced from an electrode of the cell. An electrocoating fluid including a dispersed or dissolved organic coating material is contained within the cell, and an electrical potential is applied between the cell electrode and the article. A coating of the organic material is thereby deposited on the surface of the article. As the organic coating material, anodic and cathodic resin systems, and acrylic, epoxy, polyester and polybutadiene types can be used.

Where tubular bodies such as can bodies open at one or both ends are to be coated, a cell having a cylindrical outer wall and an axially extending central mandrel therein will generally be provided. Each can body will then be positioned in a respective cell such that it is spaced from the central mandrel and the outer wall. Means will be provided to make electrical connection with the can body and with the central mandrel and/or the outer wall. Thus, if the inner surface of the can body is to be coated the central mandrel and the can body will form the electrodes of the cell. If the outer surface of the can body is to be coated the can body and the outer wall of the cell will form the electrodes. In addition, both surfaces of the can body can be coated either simultaneously or successively if an electrical potential is applied both between the can body and the mandrel and between the can body and the outer wall.

It is preferred that the electrocoating fluid flows through the cell between the electrodes during the process. Each cell will then have an inlet and an outlet for the electrocoating fluid. The electrocoating fluid can be constrained to flow over a required flow path by positively locating the can body in the cell and by providing appropriately positioned seals.

A cell in which an article is to be electrocoated is not illustrated herein as the details thereof will vary in dependence upon the type of article to be coated and as it does not form part of the present invention. Examples of cells are described in copending U.S. application Ser. No. 309,350 entitled "A method of, and apparatus for, electrocoating" and claiming priority from British patent application No. 8,033,282. The disclosure of this copending U.S. application is incorporated herein by reference.

From one of its aspects the present invention is concerned with supplying the electrocoating current to such a cell. From another aspect it is concerned with monitoring the electrocoating process so that any problems can be overcome or avoided before they cause damage necessitating shut-down of the apparatus. The invention is exemplified by the supply and monitoring circuit shown in FIG. 1 which is designed for use with apparatus having a plurality of electrocoating cells movable successively to a number of operating stations. Again, the apparatus is not described herein in detail as it is within the knowledge of any one skilled in the art, but an example of such apparatus is described in the above identified copending application. Briefly described, the apparatus of the copending application has a plurality of cells which are equally spaced circumferentially on a turntable rotatable about a central shaft. Cam operated fluid control valves are actuated to provide flow of electrocoating fluid through each individual cell when it reaches a designated operating station. Known means are provided to insert a can body into the cell at a loading station and subsequently to remove the electrocoated can body from the cell at an unloading station.

Referring now to FIG. 1, the electrical supply and monitoring circuit is shown in relation to electrocoating cells 10 which are represented schematically and which are 'm' in number. In order to connect the cells individually to the supply and monitoring circuit, two slip rings 2 are provided. The slip rings are each segmented, having the same number of segments as the number of cells. Each cell is connected electrically between respective segments of the two slip-rings, and stationary brushes 7 engage the slip-rings for making individual connection with the segments and thereby connecting the cells in succession into the supply and monitoring circuit. With this arrangement of two segmented slip-rings 2 and associated brushes 7, components of the circuit which perform a monitoring function are isolated from the power components of the circuit which supply the electrocoating current. Furthermore, as each cell is connected individually to its two slip-ring segments, electrical access to each cell is always available as required. It would therefore be easy to include further monitoring and/or supply stations as required.

In the apparatus each cell 10 is moved successively from a machine input to a machine discharge through a number of discrete regularly spaced operating stations (some of which may be unused insofar as operations upon the cell itself are concerned). In FIG. 1, the cells are considered to move at a constant, common speed from left to right as indicated by arrow A. Electrocoating current is fed to each cell in three discrete pulses at selected operating stations $n+1$, $n+2$ and $n+3$, hereinafter particularly referred to as the electrocoating stations.

The power supply is a conventional hybrid thyristor rectifier bridge 3 fed by a three-phase a.c. supply (not shown). The gate of each thyristor of the bridge 3 is connected to a timer 4 fed by clock pulses. As is subsequently described, the clock pulses are generated in synchronism with the movement of the cells through the operating stations. Thus, when the thyristors are enabled by a pulse from the timer 4 the rectifier bridge 3 will produce an output pulse which terminates when the timer pulse ends and the applied voltages to the thyristors have subsequently gone negative. As the output pulse will have components from all three stages of the bridge it will be unidirectional waveform with a ripple component. By using thyristors together with an a.c. supply there are no problems in switching off the output pulse.

The positive side of the bridge 3 is fed by way of separate output lines 9 to the three brushes 7 associated with one of the segmented slip-rings 2. The brushes 7 associated with the second slip-ring 2 are connected in common to the negative side of the bridge 3 by a return line 90. Each output line 9 includes a load resistor 5 and a thyristor switch 6.

The duration and time relation of the output pulses in relation to the movement of the slip-ring segments past the brushes 7 are such that each output pulse is fed exclusively and wholly to the three pairs of segments which at the time in question are in engagement with the brushes, so as to form electrocoating pulses for the cells connected between the pairs of segments. Generally, the output pulses will have a voltage within the range 60 to 250 volts.

The exclusive nature of the association of the output pulses with the cells enables each cell to be reliably monitored by simple means. For example, a current limiting circuit 8 is connected to each output line 9 and is arranged to compare the current in each line 9 with a present level. If the current in any line 9 exceeds the present level, for example, indicating a short-circuit in the respective cell, the current limiting circuit 8 immediately sends a signal to the timer 4 to inhibit the rectifier bridge 3 and so inhibit the electrocoating pulses to all three electrocoating stations. In addition, the current limiting circuit 8 also enters signals in a shift register 15 to provide a record of the coating deficiency of the three cells affected by the inhibition of the bridge 3. The operation of the shift register 15 will be described below. However, it will be appreciated that as it is ensured that the electrocoating pulse applied by one output line 9 is only fed to a single cell, information as to which cell has failed is immediately available.

Furthermore, as the electrocoating pulses are only present during the time that the slip ring segments of the cells at the electrocoating stations are in contact with the brushes 7, there is no danger of arcing occurring as those segments move into or out of contact with the brushes.

The time needed to electrocoat an article is dependent, inter alia, upon the electrode spacing and the coulombic yield of the electrocoating fluid. As discussed in our said copending patent application, these factors can be chosen to give very short deposition times; for example, deposition times of 300 msec can be achieved by having an electrode spacing of 1 mm and using an electrocoating fluid having a yield of 40 mgm/coulomb. However, in particular for high speed apparatus such as that particularly described in our said copending patent application, the deposition time required per article may still be too long to allow the articles to be electrocoated individually in succession. In the embodiment illustrated three separate pulses each of 100 msecs are accordingly applied to each cell and the cells are energised sequentially and progressively three at a time to give a total deposition time per cell of 300 msecs. In this way, the electrocoating time available per article is made as long as necessary without any limitation being imposed on the design speed of the apparatus.

Figure 2:
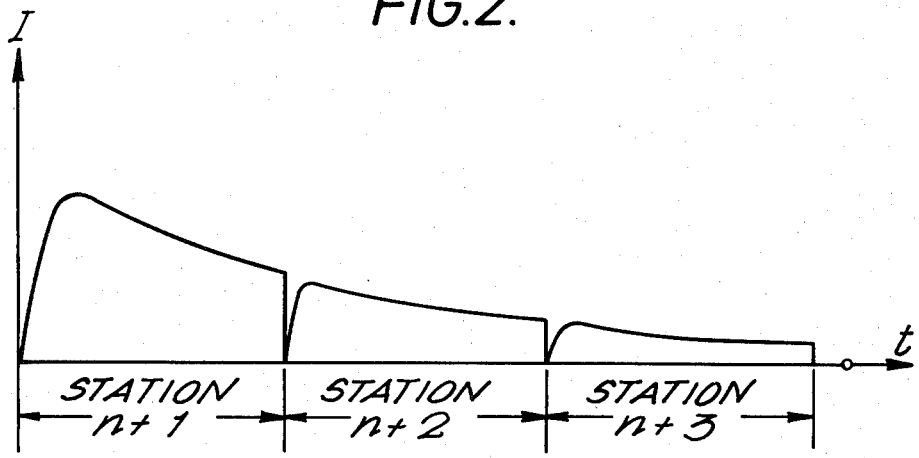
FIG. 2 shows how the electrocoating current supplied to each cell is formed of three discrete pulses supplied at respective electrocoating stations.

FIG. 2 shows how the electrocoating current taken by each cell is formed from the three discrete electrocoating pulses supplied at the electrocoating stations n+1, n+2, and n+3 respectively. The pulses are of identical time duration and result from substantially identical voltages applied to the cell. They are shown in FIG. 2 as being consecutive, although in reality they are separated in time. This consecutive representation makes clear the substantial conformity of the composite current taken by the cell during the three discrete pulses to the hypothetical current which would have been taken by the cell during a single continuous electrocoating pulse having the same total duration as the discrete pulses in combination and resulting from the same applied voltage. The discrepancy between the composite current and the hypothetical current is largely caused by inductive effects at the beginning of the discrete pulses applied at stations n+2 and n+3.

The progressive reduction in the current taken by the cell over the three periods of its energisation is due to the increase in resistance presented by the electrodeposited coating as its thickness increases. The electrocoating power required from the supply and monitoring circuit accordingly falls in an essentially progressive manner from a relatively high level at the beginning of energisation in station n+1 to a relatively low level at the end of energisation in station n+3.

Figure 3:
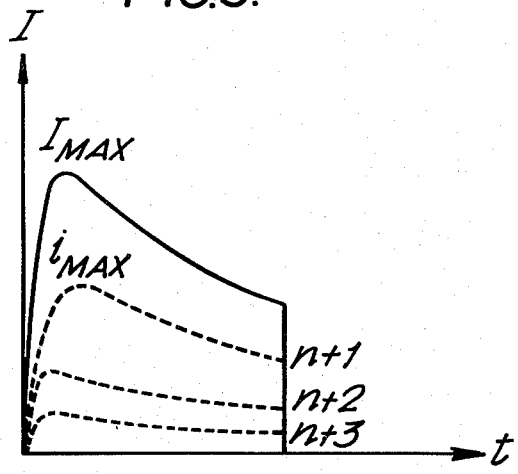
FIG. 3 shows, to the same scale as FIG. 2, the total current supplied by the supply and monitoring circuit during each output pulse, and (in dashed lines) the individual currents supplied during that time to the three electrocoating stations.

As shown in FIG. 3 which shows one output pulse, each output pulse of the supply and monitoring circuit is the sum of the electrocoating pulses simultaneously applied to the three electrocoating stations. The maximum current ($I_{max}$) required from the circuit is therefore substantially less than three times the maximum current ($i_{max}$) taken by each cell individually at the beginning of electrocoating. Moreover, the deviation of the current supplied by the circuit from its average value is substantially less than the deviation which would occur, for example, in an electrocoating apparatus of the same throughput but in which the supply and monitoring circuit was arranged to supply the cells in discrete and successive groups of three rather than in staggered or overlapping groups of three as described.

Therefore, in its function to supply electrocoating energy, the supply and monitoring circuit is used at a substantial proportion of its design power rating; moreover, and as previously mentioned, the electrical isolation of the cells and the provision of electrocoating pulses to them individually enables the cells to be monitored as they pass through the electrocoating apparatus and allows corrective or other action to be taken for them individually when required. The monitoring and control function of the supply and monitoring circuits will now be described in detail.

Referring again to FIG. 1, the supply and monitoring circuit includes a clock pulse generating circuit 11 having an associated sensor 12 which is responsive to each cell passing. The sensor 12 may be of any suitable type and may be responsive to the cells themselves (or parts thereof), or it may be triggered by the slip-ring segments connected to the cells. Whatever the form of the sensor 12, it triggers the circuit 11 to produce a clock pulse for each cell passing. Thus, it will be appreciated that the clock pulses are in synchronism with the movement of the cells past the operating stations. Furthermore, as each clock pulse is individually generated in response to the movement of one cell and is assigned to that cell, variations in the speed of the apparatus can be accommodated. The clock pulses are fed to the timer 4 to enable the production of the electrocoating voltage pulses as is described above.

Each clock pulse is additionally fed to digital shift registers 13 to 16 which each have a predetermined number of stages. Each shift register is advanced one stage by the arrival of a clock pulse so that as each cell moves through the stations of the apparatus its movement is represented in each shift register.

The apparatus is considered to have m operating stations which commence from 1. A can body is loaded into the cell at a loading station, at say station 1−P (not marked), and subsequently a lid for the cell is closed. At station 1 the clock pulse is generated and simultaneously a test is made to confirm that a can body is correctly positioned in the cell. This test can be made in several ways. For example, the lid of the cell can be sensed, either mechanically or electrically, to ensure that it is in its fully closed position. An output signal is generated by the test which is fed to a test circuit 17. The circuit 17 generates a binary signal in accordance with whether the cell has passed or failed the test. For example, a 0 output from circuit 17 could indicate that the can body is correctly positioned in the cell while a 1 signal would indicate that a can body is not correctly positioned in the cell.

The binary output signal from circuit 17 is fed into the first stage of an m stage shift register 13 and is shifted therein by one stage by each clock pulse to arrive.

If required, the output signal generated by the test could also be used to prevent electrocoating fluid being fed to a cell in which a can body is not correctly positioned, to avoid wastage of the electrocoating fluid.

As the cell continues to move through the operating positions of the apparatus its associated binary signal is correspondingly moved in register 13. Thus, when the cell reaches position n its binary signal is at stage n in the register 13.

At position n a short circuit test is performed on the cell. Thus, a testing circuit 18 applies a low voltage to the cell at position n and measures the resistance of the cell. If the resistance of the cell is sufficiently high a 0 binary signal is produced but if the resistance of the cell is too low, indicating a short circuit, a 1 binary signal is produced.

The circuit 18 includes an OR gate to which is applied the binary output signal produced by the short circuit test and the binary signal in stage n of the register 13, that is, the result of the test to confirm that the can is correctly positioned in the cell. If both these signals are 0, indicating that the electrocoating process can proceed, a 0 binary output signal is produced by the circuit 18 and fed to the first stage of shift register 14. If either or both of the signals is 1, the circuit 18 produces a 1 at its output to indicate that the application of the electrocoating voltage pulses should be inhibited.

The manner in which the two tests outlined above are performed has not been specified in detail as various means can be used. For example, the short circuit test could look for an open circuit or a resistance above a predetermined level or it could determine the existence of a physical space between the can and the part of the cell acting as the electrode. Similarly, the detailed components of circuits 17 and 18 have not been described as such circuits can be synthesized by persons skilled in the art.

In the embodiment described, a short circuit test is made on every cell and the circuit 18 then produces an output in dependence upon the results of both the tests performed on the cell. Alternatively, if required, the presence of a 0 in the n stage of the register 13 could be utilized to initiate a short circuit test on the cell at station n, the circuit 18 then producing a binary output signal indicating the result of any short circuit test made or a 1 output if no short circuit test is made.

It is preferred that the short circuit test is made on a cell after the flow of electrocoating fluid has been commenced therethrough as this allows the cell to be tested shortly before the electrocoating pulses are to be applied. At the time between the test and the application of the pulses is short, it is unlikely that conditions in the cell will change. Furthermore, the test will then indicate that electrocoating fluid is flowing through the cell.

In the embodiment illustrated, the shift register 14 has $m-(n+1)$ stages with its first stage associated with the cell at electrocoating station $n+1$. In this case, the output from the short circuit test of the cell at operating station n is fed into the register 14 when that cell reaches station $n+1$. Alternatively, the register 14 may have $m-n$ stages such that its first stage is associated with station n. In either case, as the cell from station n continues to move through the apparatus the binary signal from circuit 18 associated therewith similarly moves through the register 14 as it is advanced by the continuing arrival of clock pulses.

The stages in shift register 14 associated with the electrocoating stations $n+1$, $n+2$ and $n+3$ are each connected to the thyristor switch 6 in the respective output line 9 associated with the same station. If a binary 1 appears in any of these stages of the register 14 the respective thyristor switch 6 is immediately disabled to prevent the application of an electrocoating pulse to the associated station. Thus, no electrocoating pulses are applied to any cell which has failed either of the initial tests. Adjacent cells, however, are unaffected.

It is important that electrocoating pulses are not applied to a cell in which a short circuit appears or in which the electrocoating fluid has broken down. Otherwise, the cell could be badly damaged. For example, the article could be welded to the cell electrode and a replacement cell would be required. Thus, the short circuit test is made before any electrocoating pulses are applied. In addition, and as described above, the amount of current fed to each cell is monitored by the current limiting circuit 8 and the rectifier bridge 3 is immediately inhibited if any of the currents become excessive.

If the current limiting circuit 8 inhibits the bridge 3 it also enters a binary 1 signal in the first three stages of shift register 15. These stages correspond to the electrocoating stations $n+1$, $n+2$ and $n+3$. A binary 1 signal is entered in all three stages of the register 15 as the electrocoating at all three stations $n+1$, $n+2$ and $n+3$ will have been adversely affected by the inhibition of the rectifier bridge.

The stages of register 15 corresponding to electrocoating stations $n+2$ and $n+3$ are each connected to the thyristor switch 6 in the respective output line 9 associated with these two stations. Thus, when a 1 appears in either of these two stages application of an electrocoating pulse to the corresponding station is prevented. In this way it is provided that no effort is made to electrocoat a can body, the coating of which is already deficient because of operation of the current limiting circuit 8.

The amount of current fed to each cell at stations $n+1$, $n+2$ and $n+3$ is also monitored by a coulomb meter circuit 19 which has three inputs each connected to a respective output line 9. Each input of the cicuit 19 is connected to an integrating circuit which integrates the current fed along the respective line 9 with respect to time to thereby provide a measure of the total number of coulombs fed to each station. The coulomb meter circuit 19 includes means, such as a register, for storing the integrated quantity produced at each input. Clock pulses are applied to the circuit 19 to advance the quantities stored in the register to thereby produce a cumulative total at its output. This total will represent the quantity of coulombs fed to one cell which has passed through stations $n+1$, $n+2$ and $n+3$. At the output of the circuit 19 the cumulative total is compared with a preset value. If the total is above the preset value the circuit 19 enters a 0 in the first stage of register 16, whilst if the total is below the preset value because the cell at station $n+3$ has not received a sufficient number of coulombs, a 1 is entered in the first stage of register 16. The first stage of register 16 may correspond to either station $n+3$ or the next adjacent station.

It will be appreciated that the coulomb meter circuit 19 is acting as a quality control means as only if a sufficient number of coulombs have been passed to a cell can a satisfactory coating have been produced.

At the end of one complete cycle of the apparatus the first cell will be at the station m which is the unloading station. As each of the registers 13 to 16 has a last stage corresponding to the station m the process history of the cell at the unloading station is available. This information can be used simply to determine whether the article unloaded from the cell at station m should be unloaded into an accept or a reject channel. Thus, as shown in FIG. 1, the last stage of each register 13 to 16 can be connected to a decoder 20 which will be connected to control the unloading mechanism. In the embodiment described above, each fault condition is represented by a 1 signal whilst an accept condition is represented by a 0 signal. Accordingly, the decoder 20 can be a simple OR gate producing a 0 only when each of the registers has a 0 in its m stage. The production of a 0 by the decoder 20 would then control the unloading means to unload the article from the cell into the accept channel. Where a 1 appeared in the m stage of any register the article would be unloaded into the reject channel.

It will be appreciated that where the information from the registers 13 to 16 is simply used to control the unloading mechanism, this information will be immediately lost once the registers have been advanced by the next clock pulse. For most applications this would be acceptable. Of course, auxiliary means could be provided to retain information if required.

It would be useful to know if a particular cell, or cells, is consistently registering faults so that remedial action can be taken. To do this, each cell is assigned a number from 1 to m. An m stage counter (not shown), advanced by the clock pulses, is provided and means are provided to reset the counter to 1 when the cell marked 1 is at station 1. Thus, at any time the counter will identify the cell whose process history is entered in the m stage of each register 13 to 16. It is then only necessary to provide storage means for the information available. For example, an auxiliary m stage register could be connected to the counter and the counter could enter a digit in the appropriate stage whenever an article from a particular cell is rejected. This would give a visible record of any numbered cell having more than an average number of faults such that the cell could be checked.

The electrocoating apparatus particularly described above with reference to the drawings is arranged so that each cell is supplied with an electrocoating pulse at each one of the electrocoating stations. Such an arrangement, however, is not essential, and in a variation of the described apparatus two pairs of segmented slip-rings are provided and each connected across alternate ones of the cells around the turntable. The electrocoating pulses are supplied to the segments associated with four consecutive cells, with the result that the cells are grouped in pairs for the electrocoating process and each receives two electrocoating pulses. The slip-ring segments individually have approximately twice the length of the segments of the slip-rings 2 thus enabling a correspondingly increased pulse length to be used for the electrocoating pulses at the same rotational speed of the turntable. The segments of each pair of slip-rings are longitudinally displaced by half their length in relation to the segments of the other pair of slip-rings, with the result that the total available electrocoating time for each cell is increased by a factor of 4/3 in relation to the electrocoating time available for the cells of the arrangement particularly described. This non-illustrated variation therefore enables longer electrocoating times to be used but at the expense of some increase in complexity and cost. It will be appreciated that in the variation the electrocoating stations are not spaced at discrete intervals around the turntable as in the arrangement described and shown; instead, they are located in staggered, mutually overlapping relationship.

We claim:

1. An electrocoating apparatus comprising a plurality of discrete electrocoating stations, a plurality of electrocoating cells, means for introducing electrocoating fluid into each of said electrocoating cells, means for moving each electrocoating cell successively to each of said electrocoating stations, and means for periodically supplying a unidirectional electrical pulse as an electrocoating pulse to each of said electrocoating stations at a time when electrocoating fluid is present in a said cell which is located at the electrocoating station whereby a plurality of discrete electrocoating pulses are applied to each cell containing electrocoating fluid as it is moved to said electrocoating stations in succession.

2. Apparatus according to claim 1, wherein the cells are consecutively disposed for sequential movement to said electrocoating stations which themselves are consecutive.

3. Apparatus according to claim 1, which includes further electrocoating cells separating the first said electrocoating cells and likewise movable successively to each of a plurality of further electrocoating stations at which they are electrically energisable, the said means being arranged to supply the electrocoating pulse to each of said further electrocoating stations simultaneously with the first said electrocoating stations and at a time when electrocoating fluid is present in a said further cell which is located at the further electrocoating station, a plurality of discrete electrocoating pulses being thereby applied to each further cell as it is moved to each of said further electrocoating stations in succession.

4. Apparatus according to claim 1, further comprising means to inhibit the supply of electrocoating pulses to the electrocoating stations if the current supplied to any electrocoating station exceeds a predetermined value.

5. Apparatus according to claim 1, further comprising means for determining the time integral of the current fed to each cell, said time integral being representative of the coulomb quantity fed to said cell.

6. An electrocoating apparatus comprising: a plurality of electrocoating cells movable successively to each of a plurality of electrocoating stations at which they are electrically energizable, means for introducing electrocoating fluid into said electrocoating cells, means for periodically supplying one or more unidirectional electrical pulses as electrocoating pulses to each of said electrocoating stations at a time when electrocoating fluid is present in a cell which is located at an electrocoating station, a plurality of discrete electrocoating pulses being thereby applied to each cell as it is moved to each of said electrocoating stations in succession, and means for determining the time integral of the current fed to each cell, said time integral being representative of the coulomb quantity fed to said cell.

7. Apparatus according to claim 6, wherein said means for determining the time integral of the current fed to each cell comprises integrating means determining the time integral of the current fed to each electrocoating station during each electrocoating pulse, means for storing the time integral associated with each electrocoating station, and means for totalling the stored time integrals derived successively from all of the electrocoating stations.

8. Apparatus according to claim 6, or claim 7, further comprising means for comparing the time integral of the current fed to each cell with a predetermined value and generating an output signal, and means for storing the output signal relating to each cell.

9. Apparatus according to claim 8, wherein each cell is movable subsequently to an unloading station and further comprising means for unloading the cell at said unloading station, said unloading means being arranged to unload each cell under the control of the stored output signal relating to that cell.

10. An electrocoating apparatus comprising a plurality of discrete operating stations, a plurality of electrocoating cells, means for introducing electrocoating fluid into each of said electrocoating cells, means for moving each electrocoating cell successively to each of said discrete operating stations, means for supplying unidirectional electrical pulses as electrocoating pulses to a selected one of said operating stations at a time when electrocoating fluid is present in a said cell which is located at said selected operating station, means for testing at least one parameter of each cell, and means for inhibiting the supply of said electrocoating pulses to any selected operating station at which a cell which fails said test is located.

11. Apparatus according to claim 10, wherein articles to be electrocoated are loaded successively into the cells at a first operating station, and wherein said testing means are arranged to test that an article is correctly located in each cell at a second subsequent operating station.

12. Apparatus according to claim 10, wherein said testing means are arranged to test that the cell at a third operating station has an open circuit.

13. Apparatus according to claim 10, wherein said testing means are arranged to test that the current supplied to the cell at the or each said selected operating station does not exceed a predetermined value.

14. An electrocoating apparatus comprising a plurality of discrete operating stations, a plurality of electrocoating cells, means for introducing electrocoating fluid into each of said electrocoating cells, means for moving each electrocoating cell successively to each of said discrete operating stations, means for supplying unidirectional electrical pulses as electrocoating pulses to a selected one of said operating stations at a time when electrocoating fluid is present in a said cell which is located at said selected operating station, and means representing the movement of each cell to the operating stations in succession.

15. Apparatus according to claim 14, further comprising means for testing the condition of each cell and producing an output signal representative of that condition, and wherein said means representing movement of each cell comprises storage means for storing each output signal and means for advancing each output signal in said storage means as the cell from which it is derived is advanced relative to the operating stations.

16. Apparatus according to claim 15, wherein said testing means is arranged to test each cell at one selected operating station, and wherein said storage means comprises at least one shift register having a plurality of stages each representing one of the operating stations, said output signal being fed to the stage of the register representative of said selected operating station and being advanced to successive stages as the cell from which it is derived moves to the operating stations represented thereby.

17. Apparatus according to claim 16, further comprising clock pulse generating means generating clock pulses dependent upon the movement of the cells, said clock pulses being connected to advance the or each shift register.

18. In or for electrocoating apparatus comprising a plurality of discrete electrocoating stations, a plurality of electrocoating cells, and means for moving each electrocoating cell successively to each of said electrocoating stations, an electrical supply monitoring circuit comprising a plurality of output lines each connected to a respective electrocoating station, means for generating a succession of unidirectional electrical pulses, and means for delivering each successive electrical pulse in parallel to said plurality of output lines as electrocoating pulses for said electrocoating cells at said electrocoating stations, and means for inhibiting the generation of said pulses if the current flowing in any of said output lines exceeds a predetermined value.

19. A circuit according to claim 18, further comprising means for repetitively summing the time integrals of the currents flowing in the output lines taken in succession so as to provide a cumulative total of the number of coulombs fed to the cells individually as they pass through the electrocoating stations.

20. In or for an electrocoating apparatus comprising a plurality of discrete electrocoating stations, a plurality of electrocoating cells, and means for moving each electrocoating cell successively to each of said electrocoating stations, an electrical supply and monitoring circuit comprising a plurality of output lines each connected to a respective electrocoating station, means for generating a succession of unidirectional voltage pulses, switching means for connecting said pulses in parallel to said plurality of output lines as electrocoating pulses for said electrocoating cells at said electrocoating stations, and information storage means for selectively operating said switching means in accordance with the information in said storage means.

21. A method of monitoring and controlling the operation of an electrocoating apparatus in which a plurality of electrocoating cells are moved successively to each of a plurality of operating stations, the method comprising the steps of testing one or more parameters of each cell against a predetermined standard, and only if the cell meets the standard, subsequently applying one or more unidirectional electrical pulses to that cell as electrocoating pulses therefor.

22. A method according to claim 21, wherein articles to be electrocoated are loaded successively into the cells at a first operating station, and wherein each cell at a second subsequent station is tested for correct location of an article in that cell.

23. A method according to claim 21, wherein each cell at a third operating station is tested to ensure that it has an open circuit.

24. A method according to claim 21, wherein the application of electrical pulses to each cell as electrocoating pulses therefor is inhibited if the current fed to the cell exceeds a predetermined value.

* * * * *

UNITED STATES PATENT AND TRADEMARK OFFICE

CERTIFICATE OF CORRECTION

PATENT NO. : 4,452,680

DATED : June 5, 1984

INVENTOR(S) : Douglas H. Jackson et al.

It is certified that error appears in the above-identified patent and that said Letters Patent is hereby corrected as shown below:

On The Title Page insert:

-- /73/ Assignee: Metal Box Limited

Reading, England --.

Signed and Sealed this

First Day of January 1985

[SEAL]

*Attest:*

GERALD J. MOSSINGHOFF

*Attesting Officer*

*Commissioner of Patents and Trademarks*